US007866328B2

(12) United States Patent
Chen

(10) Patent No.: US 7,866,328 B2
(45) Date of Patent: Jan. 11, 2011

(54) COSMETIC CONTAINER

(76) Inventor: Sin-Hsiung Chen, No. 140, Cheng-Pei 1 Rd., Yung Kang City, Tainan Hsien (TW)

( * ) Notice: Subject to any disclaimer, the term of this patent is extended or adjusted under 35 U.S.C. 154(b) by 505 days.

(21) Appl. No.: 12/005,534

(22) Filed: Dec. 27, 2007

(65) Prior Publication Data

US 2009/0126758 A1 May 21, 2009

(30) Foreign Application Priority Data

Nov. 21, 2007 (TW) ..... 96144019 A

(51) Int. Cl.
*A45D 33/20* (2006.01)
*A45D 33/22* (2006.01)
*B67D 7/06* (2010.01)

(52) U.S. Cl. ..... 132/287; 132/295; 222/182; 222/183; 222/129; 222/135

(58) Field of Classification Search ..... 132/286, 132/287, 291, 293–296, 300, 314–316; 206/581, 206/823, 38; 220/820, 345.1, 345.4, 351; 222/182, 183, 129, 135
See application file for complete search history.

(56) References Cited

U.S. PATENT DOCUMENTS 4,886,080 A 12/1989 Cole
5,226,541 A 7/1993 Huang
5,513,754 A * 5/1996 Chang ..... 206/581
6,682,242 B1 1/2004 Montoli
6,726,016 B2 4/2004 Chen
7,287,923 B1 10/2007 Chen
7,370,754 B2 * 5/2008 Kushner ..... 206/38
2005/0087207 A1 4/2005 Rousselet
2006/0130868 A1 6/2006 Noel

* cited by examiner

*Primary Examiner*—Rachel R Steitz
(74) *Attorney, Agent, or Firm*—Jackson Walker, LLP

(57) ABSTRACT

A cosmetic container has a first casing and a second casing. The first casing has a chamber and at least one bottle. The at least one bottle is mounted in the bottle. The second casing is mounted slidably on the first casing and has a base and a cover. The base is mounted slidably on the first casing and has multiple compartments. The cover is mounted pivotally on the base and selectively covers the compartments. The cosmetic container has the at least one bottle and compartments hold and arrange orderly different cosmetic products so that the user would not need to carries different cosmetic bottles and boxes.

11 Claims, 11 Drawing Sheets

COSMETIC CONTAINER

BACKGROUND OF THE INVENTION

1. Field of the Invention

The present invention relates to a container, and more particularly to a cosmetic container that carries and orderly holds different cosmetic products.

2. Description of Related Art

The nature of humans, especially to females, favors to be good looking. Therefore, cosmetic products are always popular and marketable. Nowadays, cosmetic products are not only characterized in the contents and utility but also in containers thereof to attract consumers' attentions and favor.

A conventional cosmetic container is always specialized to hold only one cosmetic content. For example, the cosmetic containers designed respectively for eyelash extensions, foundation and eye shadow are quite different in sizes and shapes and cannot be integrated into a single package. A user needs to carry all these cosmetic containers when he/she has to make up timely.

However, carrying those cosmetic containers in a bag or purse is inconvenient because the cosmetic containers are easily scrappy in everywhere inside the bag or purse and the user always needs to spend time to find a certain cosmetic container needed timely.

To overcome the shortcomings, the present invention provides a cosmetic container to mitigate or obviate the aforementioned problems.

SUMMARY OF THE INVENTION

The main objective of the invention is to provide a cosmetic container that carries and orderly holds different cosmetic products.

A cosmetic container in accordance with the present invention comprises a first casing and a second casing. The first casing has a chamber and at least one bottle. The at least one bottle is mounted in the bottle. The second casing is mounted slidably on the first casing and has a base and a cover. The base is mounted slidably on the first casing and has multiple compartments. The cover is mounted pivotally on the base and selectively covers the compartments. The cosmetic container has the at least one bottle and compartments hold and arrange orderly different cosmetic products so that the user would not need to carries different cosmetic bottles and boxes.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
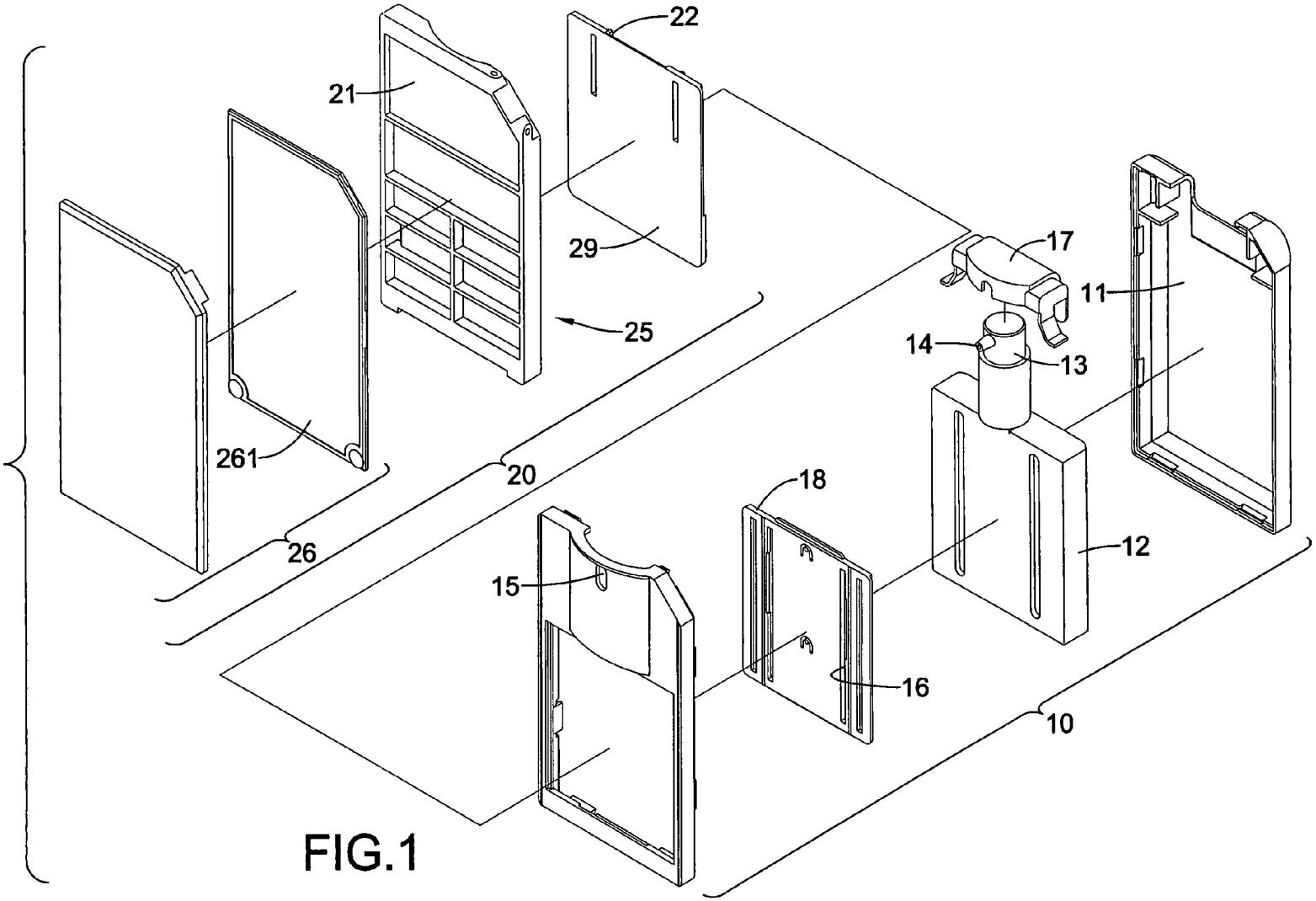
FIG. 1 is an exploded perspective view of a first embodiment of a cosmetic container in accordance with the present invention.
Figure 2:
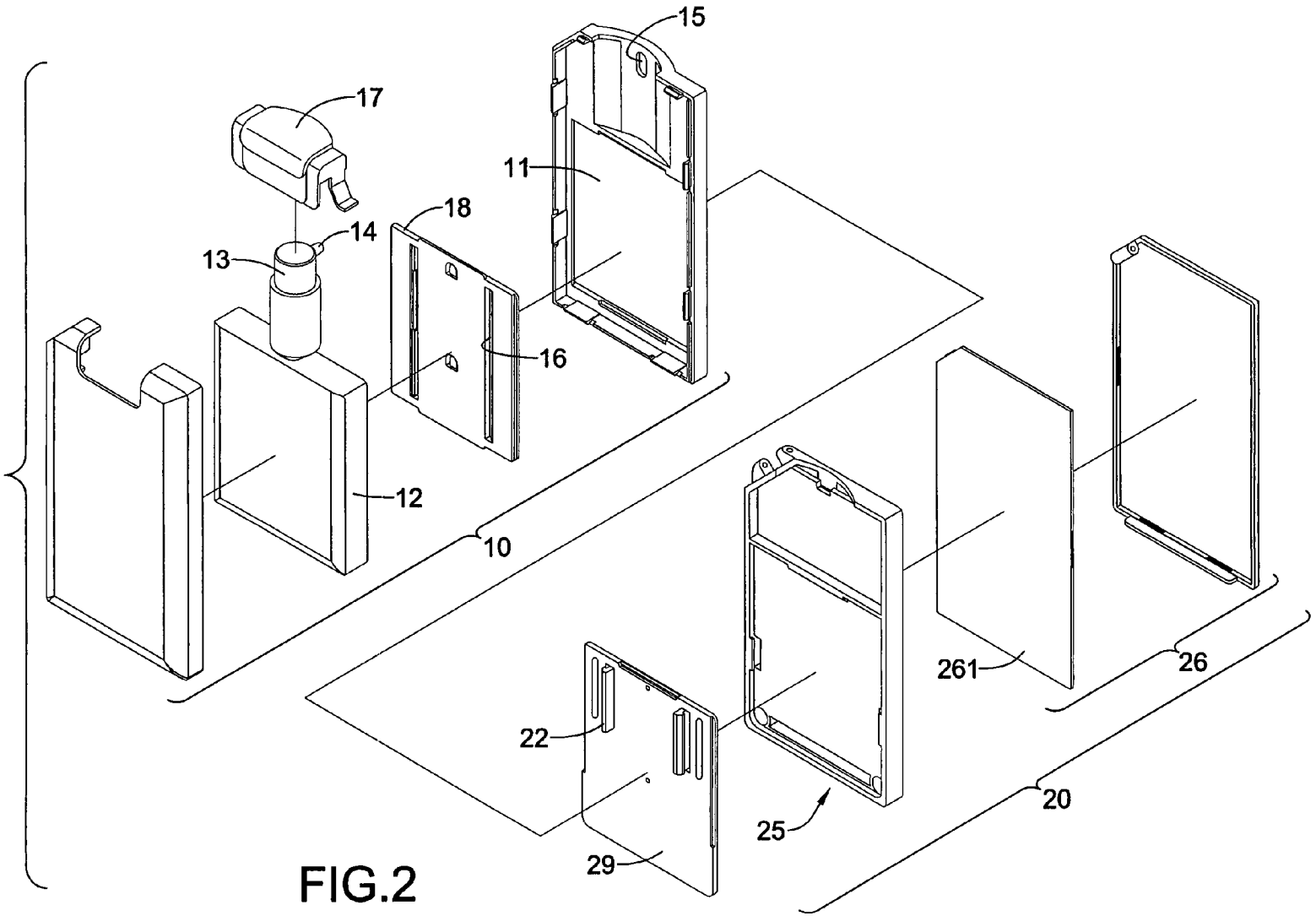
FIG. 2 is another exploded perspective view of the cosmetic container in FIG. 1.
Figure 3:
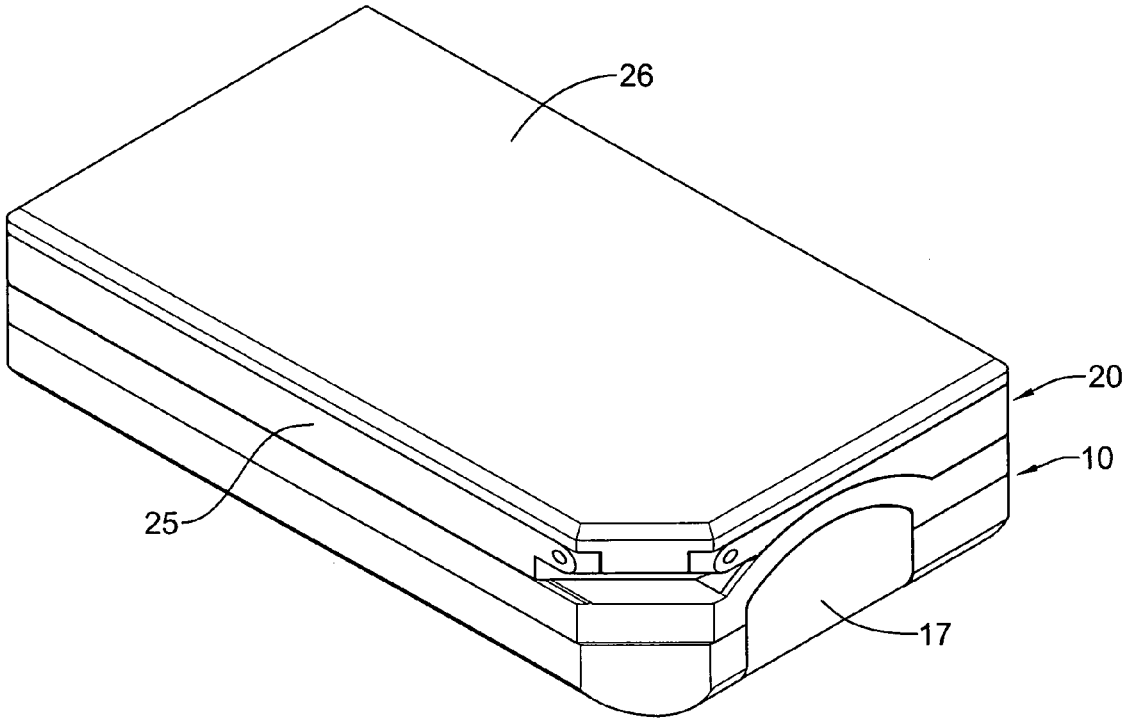
FIG. 3 is a perspective view of the cosmetic container in FIG. 1.

With reference to FIGS. 1 to 3, a first embodiment of a cosmetic container in accordance with the present invention comprises a first casing (10) and a second casing (20).

The first casing (10) may comprise an outer casing half and an inner casing half and has a chamber (11), an opening, a mounting slot (15), at least one bottle (12) and a slide board (18).

The inner casing half is mounted on the outer casing half.

The chamber (11) is defined in the first casing (10) and has an open top.

The opening is defined through the first casing (10), communicates with the chamber (11) and may be defined through the inner casing half.

The mounting slot (15) is defined through the first casing (10), communicates with the chamber (11) and may be defined through the inner casing half.

With reference to FIG. 4 to 6 and 11, the at least one bottle (12) may receive cosmetic fluid such as perfume or liquid foundation and is mounted in the chamber (11). Each bottle (12) is hollow and has cavity, a sprayer (13) and a press button (17). The cavity is defined in the bottle (12) and may receive the cosmetic fluid. The sprayer (13) is mounted movably on the bottle (12) and has a nozzle (14). The nozzle (14) is formed on the sprayer (13), communicates with the cavity and extends slidably through the mounting slot (15). The press button (17) is mounted movably in the open top of the chamber (11) and abuts the sprayer (13). Pressing the press button (17) depresses and activates the sprayer (13) to spray out the cosmetic fluid.

The slide board (18) is mounted securely in the opening of the first casing (10) and may have two rail slots (16). The rail slots (16) are defined through the slide board (18) and each rail slot (16) has an inner edge.

The second casing (20) are mounted slidably on the first casing (10) and has a base (25) and a cover (26).

Figure 4:
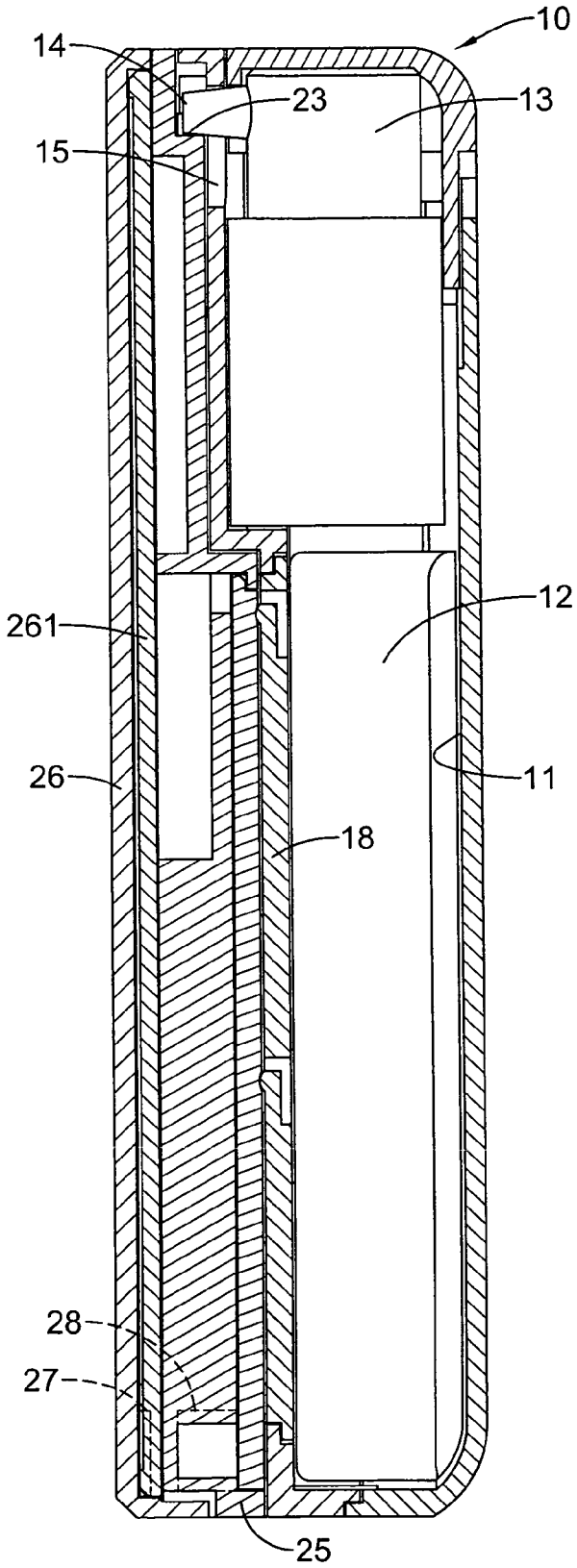
FIG. 4 is a side view in partial section of the cosmetic container in FIG. 3.
Figure 5:
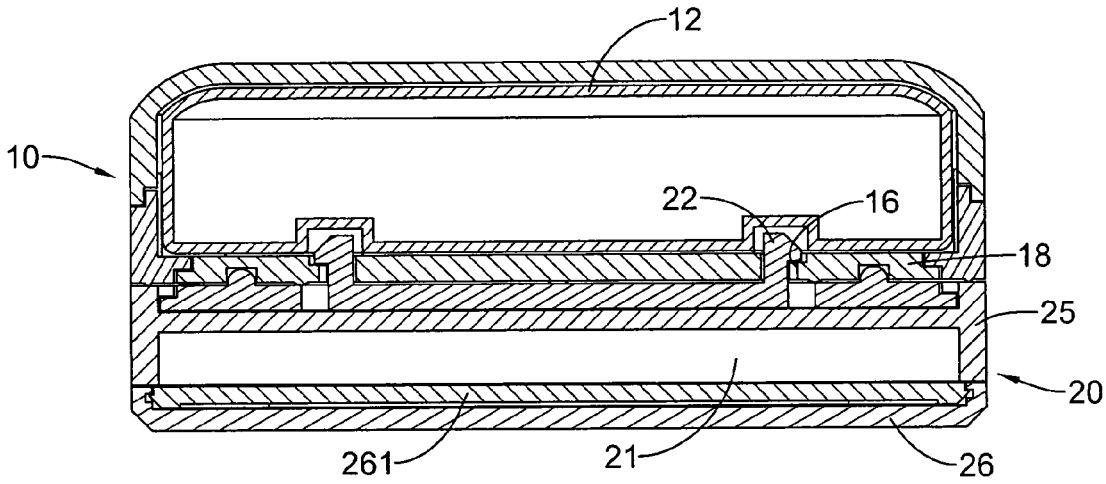
FIG. 5 is a cross sectional top view of the cosmetic container in FIG. 3.
Figure 6:
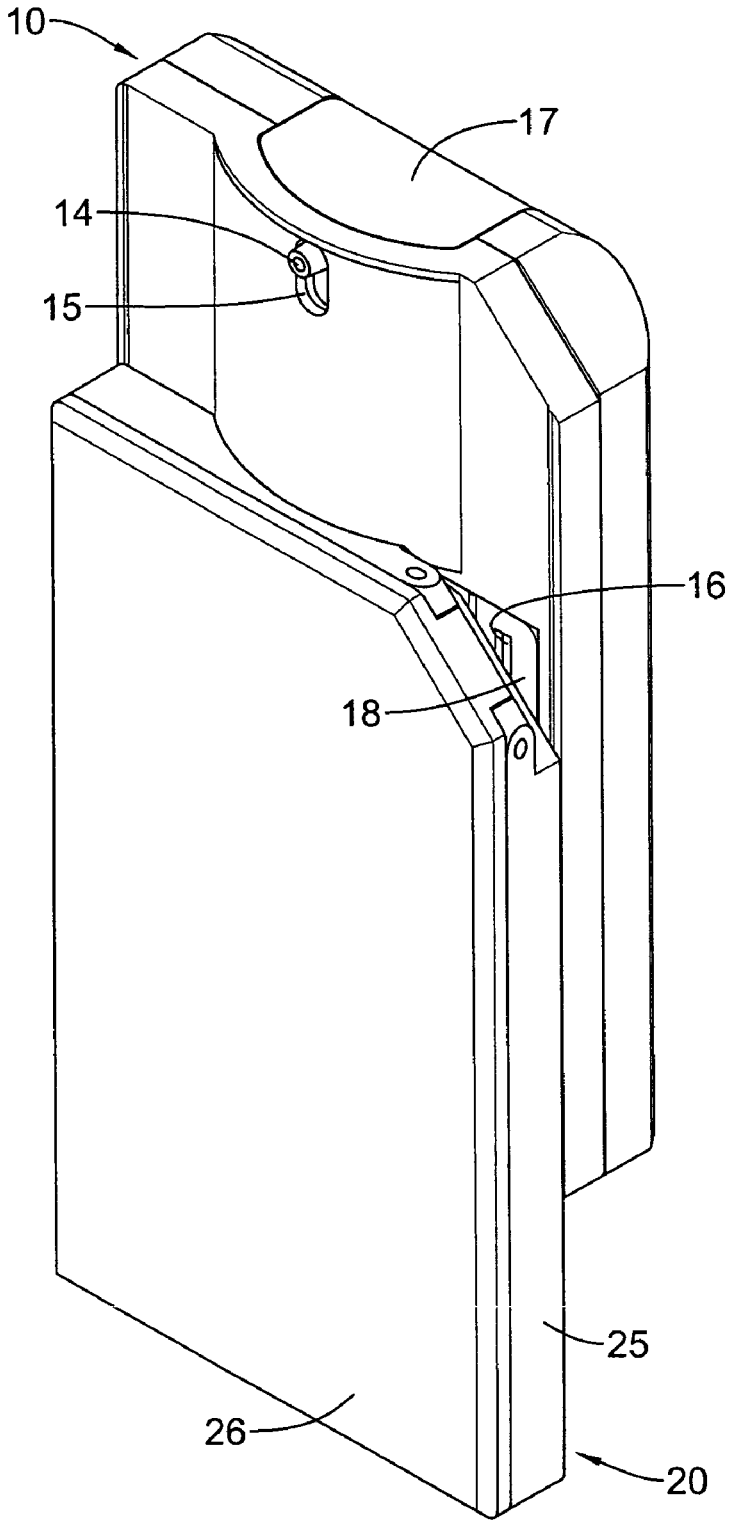
FIG. 6 is an operational perspective view of the cosmetic container in FIG. 3 showing the first casing sliding up relative to the second casing.

The base (25) is mounted slidably on the slide board (18) of the first casing (10), has an inside surface, an outside surface, multiple compartments (21) and a sliding board (29) and may further have a limiting block (23) and multiple positioning members (28). The outside surface is opposite to the inside surface. The compartments (21) are defined in the outside surface of the base (25) and may receive different cosmetic powder or cream. The sliding board (29) is mounted securely on the inside surface of the base (25), is engaged slidably with the slide board (18) of the first casing (10) and may have two sliding hooks (22). The sliding hooks (22) are formed on and protrude out from the sliding board (29) and slidably hook respectively on the inner edges of the rail slots (16) in the slide board (18). The limiting block (23) is formed on the inside surface of the base (25) and abuts the nozzle (14) of the at least one bottle (12) and prevents the sprayer (13) of each bottle (12) from being pressed when the second casing (20) is lapped entirely on the first casing (10), as shown in FIG. 4.

The positioning members (28) are mounted in the base (25) and may be magnets or metal.

Figure 8:
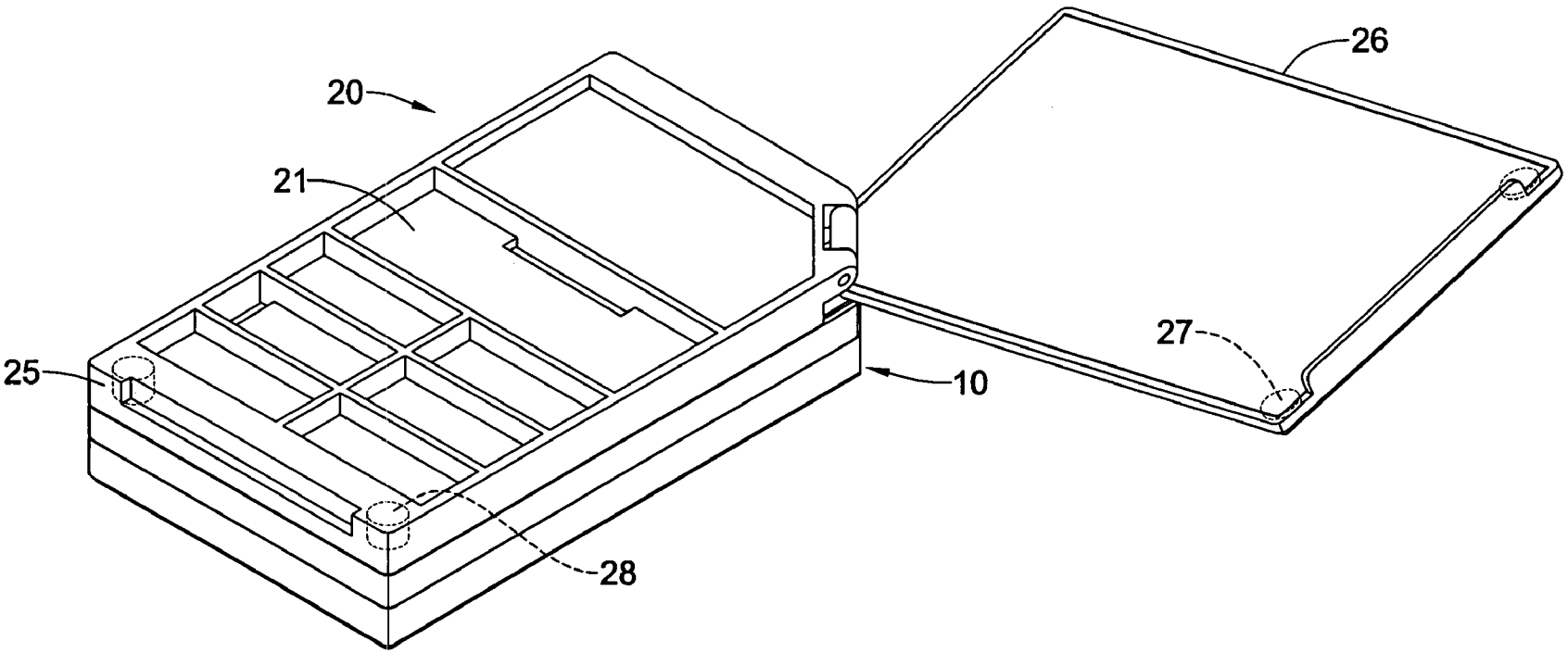
FIG. 8 is an operational perspective view of the cosmetic container in FIG. 3 showing the cover is a lift lid being capable of lifting relative to the outside surface of the base of the second casing.

With further reference to FIG. 8, the cover (26) is mounted pivotally on the outside surface of the base (25), selectively covers the compartments (11) in the base (25) and may be a lift lid capable of lifting relative to the outside surface of the base (25). The cover (26) has an inside surface and may have multiple positioning elements (27) and a mirror (261). The positioning elements (27) are mounted in the cover (26) and are selectively engaged respectively with the positioning members (28) in the base (25) through magnetic attracting forces. The positioning elements (27) may be magnets or metal. The mirror (261) is mounted on the inside surface of the cover (26).

Figure 7:
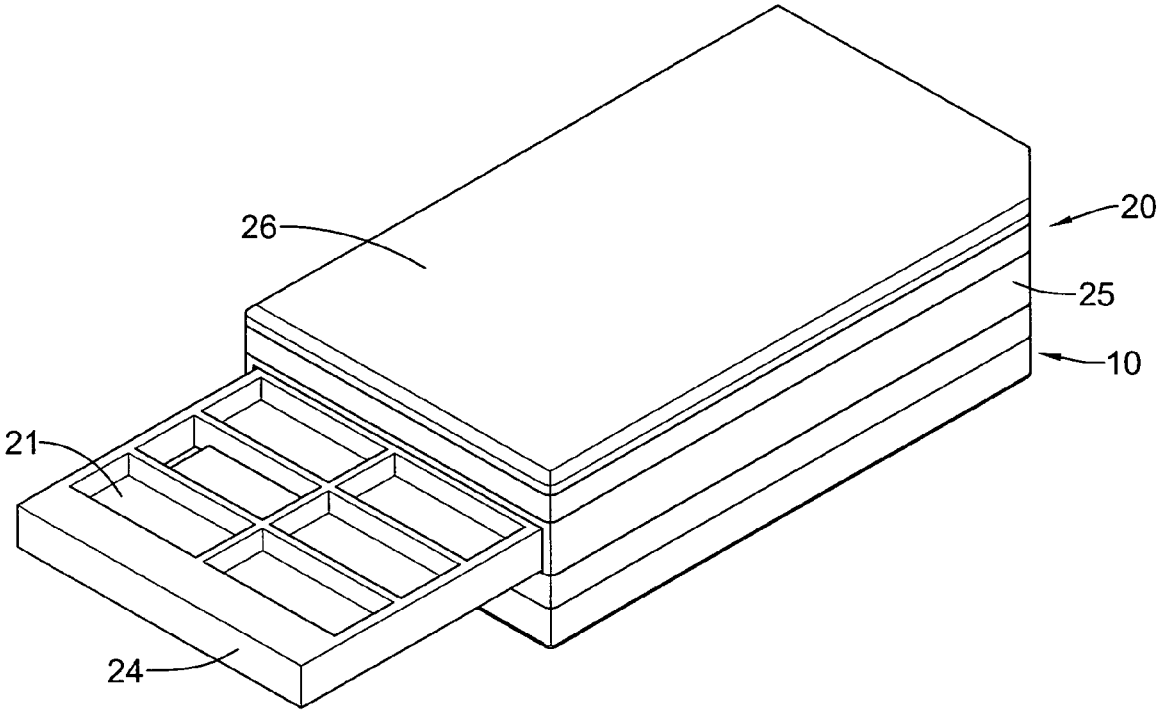
FIG. 7 is a perspective view of a second embodiment of a cosmetic container in accordance with the present invention.

With reference to FIG. 7 a second embodiment of the cosmetic container in accordance with the present invention is similar to the first embodiment and has a drawer (24) mounted slidably in the base (25) and the compartments (21) are defined in the drawer (24).

Figure 9:
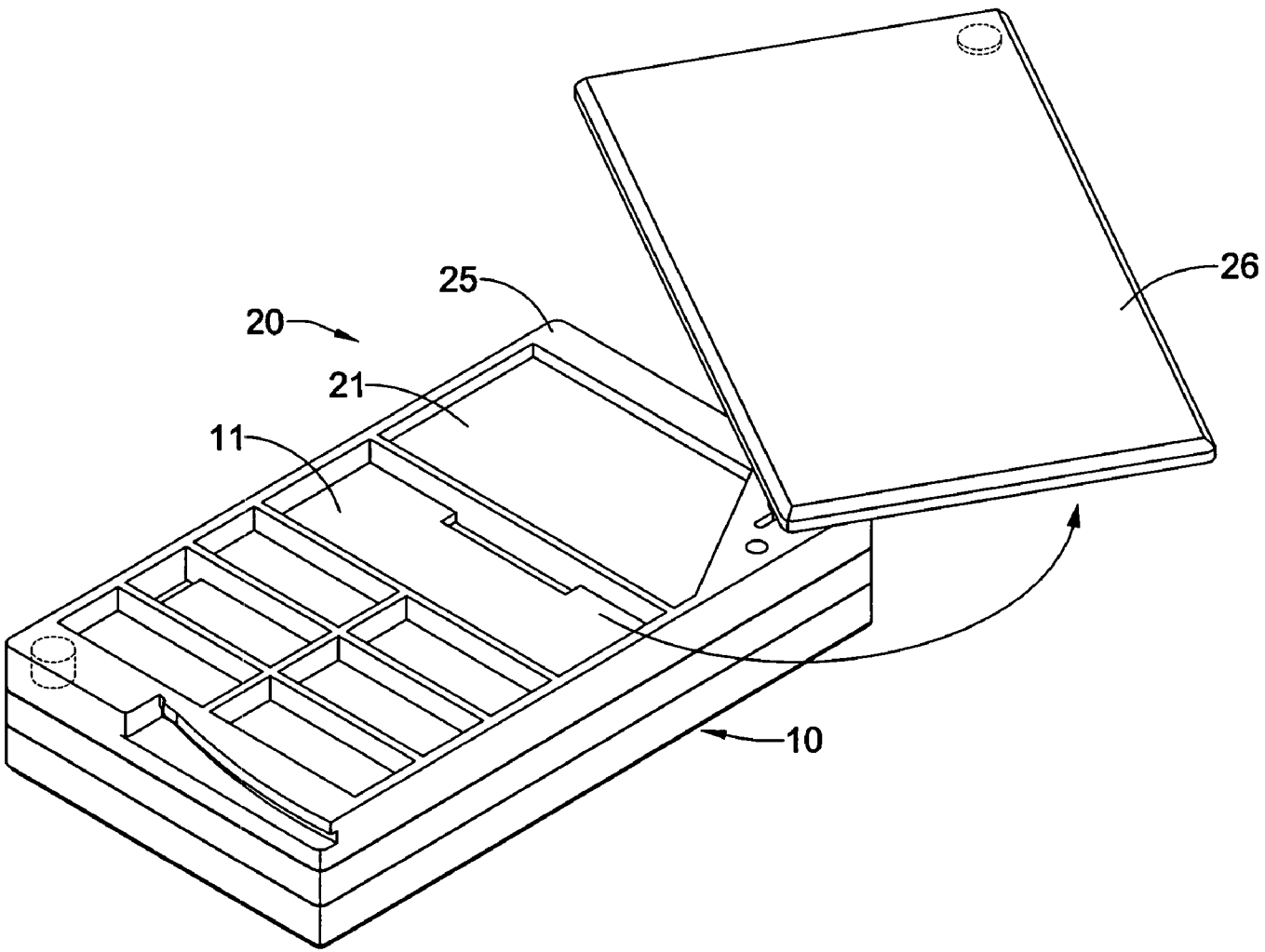
FIG. 9 is an operational perspective view of a third embodiment of a cosmetic container in accordance with the present invention showing the cover pivoting in a plane parallel to the outside surface of the base of the second casing.

With reference to FIG. 9, a third embodiment of the cosmetic container in accordance with the present invention is similar to the first embodiment and has the cover (26) being capable of pivoting in a plane parallel to the outside surface of the base (25).

Figure 10:
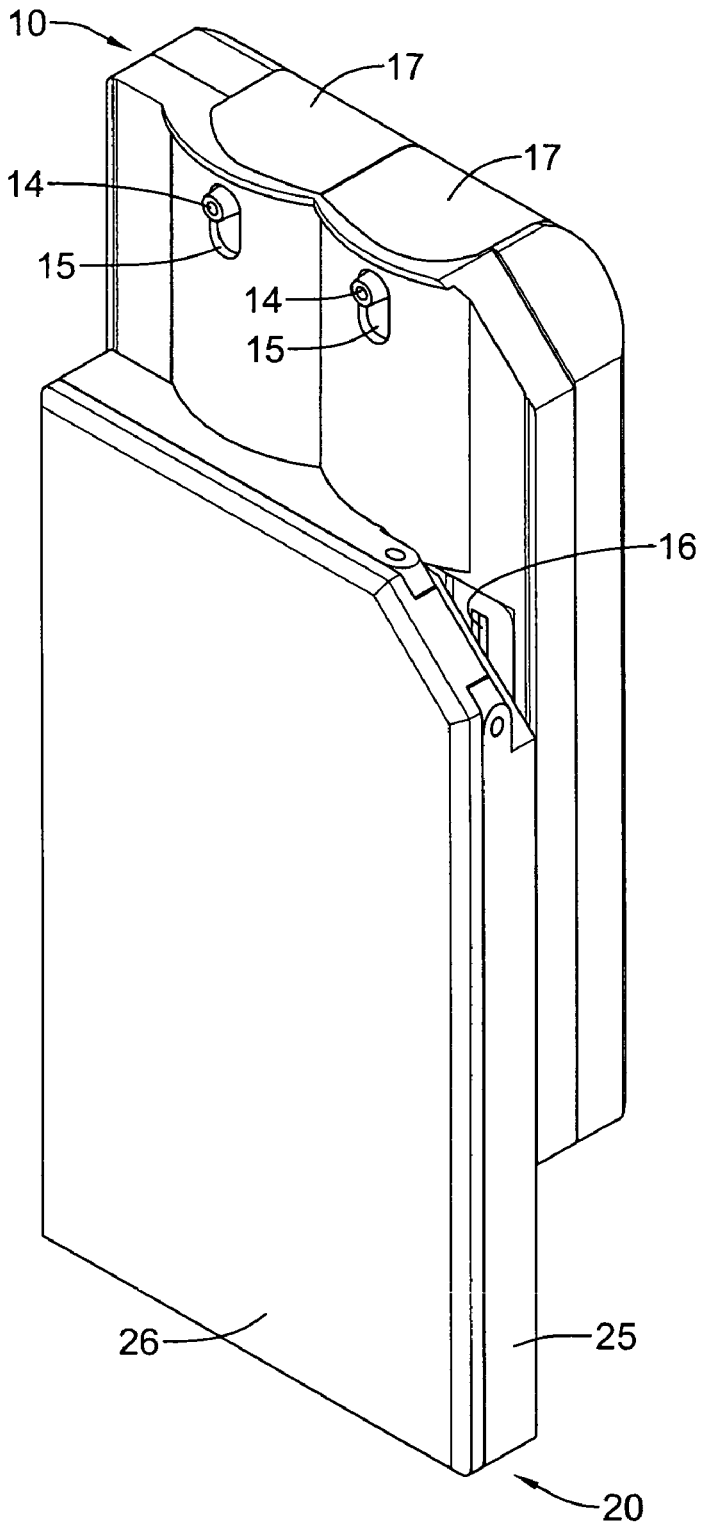
FIG. 10 is an operational perspective view of a fourth embodiment of a cosmetic container in accordance with the present invention with two bottles.
Figure 11:
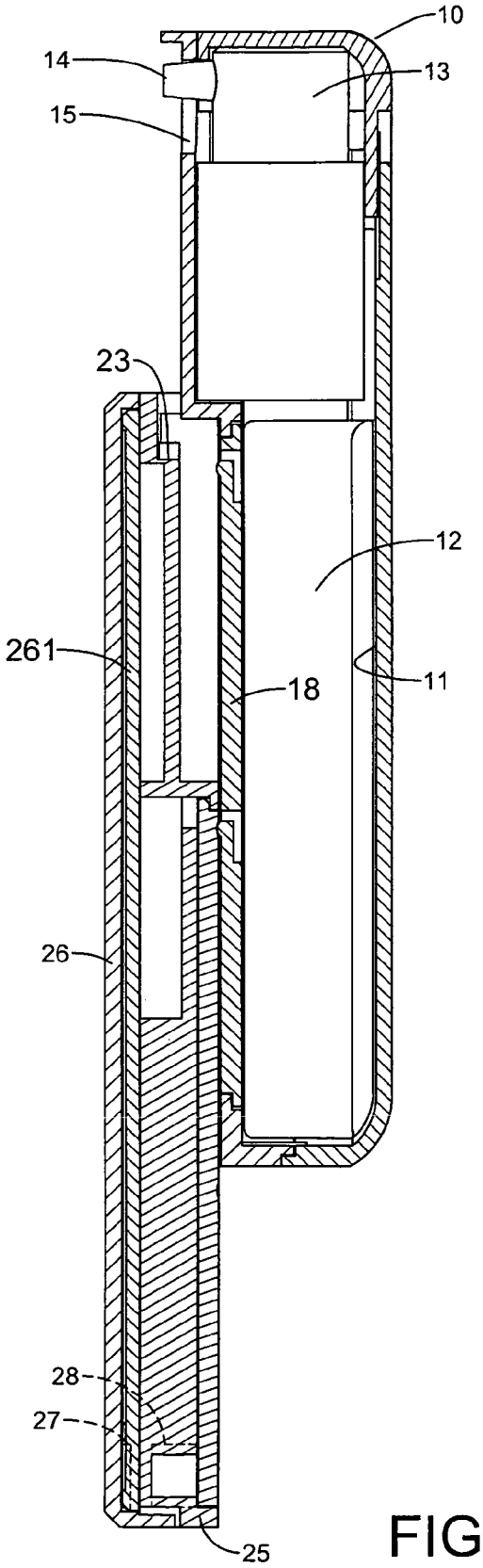
FIG. 11 is a side view in partial section of the cosmetic container in FIG. 6.

With further reference to FIG. 10, a fourth embodiment of the cosmetic container in accordance with the present invention is similar to the first embodiment and further has multiple bottles (12) arranged abreast in the chamber (11).

The cosmetic container has the at least one bottle (12) and compartments (11) hold and arrange orderly different cosmetic products so that the user would not need to carries different cosmetic bottles and boxes. Furthermore, the limiting block (23) of the second casing (20) prevent the sprayer (13) of the at least one bottle (12) from being pressed inadvertently when the first casing (10) is lapped entirely on the second casing (20) to change the cosmetic container into a compact configuration. Therefore, inadvertently spraying the cosmetic fluid in the bottle (13) is prevented.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cosmetic container comprising:

a first casing having a chamber defined in the first casing and having an open top;

an opening defined through the first casing and communicating with the chamber;

a mounting slot defined through the first casing and communicating with the chamber;

at least one bottle being hollow and each bottle having a cavity defined in the bottle, a sprayer mounted movably on the bottle and a nozzle formed on the sprayer, communicating with the cavity and extending slidably through the mounting slot; and a slide board mounted securely in the opening of the first casing; and a second casing mounted slidably on the first casing and having a base mounted slidably on the slide board of the first casing and having an inside surface;

an outside surface;

multiple compartments defined in the outside surface of the base; and a sliding board mounted securely on the inside surface of the base and engaged slidably with the slide board of the first casing; and a cover mounted pivotally on the outside surface of the base, selectively covering the compartments in the base and having an inside surface;

wherein the base of the second casing further has a limiting block formed on the inside surface of the base, and the limiting block abuts the nozzle of the at least one bottle to prevent the sprayer of each bottle from being pressed when the second casing is lapped entirely on the first casing.

2. The cosmetic container as claimed in claim 1, wherein the base has a drawer mounted slidably in the base and the compartments are defined in the drawer.

3. The cosmetic container as claimed in claim 2, wherein:

the slide board of the first casing has two rail slots defined through the slide board and each rail slot having an inner edge; and the sliding board of the second casing has two sliding hooks formed on and protruding out from the sliding board and slidably hooking respectively on the inner edges of the rail slots in the slide board.

4. The cosmetic container as claimed in claim 3, wherein the cover of the second casing is a lift lid being capable of lifting relative to the outside surface of the base.

5. The cosmetic container as claimed in claim 3, wherein the cover is capable of pivoting in a plane parallel to the outside surface of the base.

6. The cosmetic container as claimed in claim 4, wherein:

the base further has multiple positioning members mounted in the base; and the cover has multiple positioning elements mounted in the cover and selectively engaged respectively with the positioning members in the base through magnetic attracting forces.

7. The cosmetic container as claimed in claim 5, wherein:

the base further has multiple positioning members mounted in the base; and the cover has multiple positioning elements mounted in the cover and selectively engaged respectively with the positioning members in the base through magnetic attracting forces.

8. The cosmetic container as claimed in claim 6, wherein the cover has a mirror mounted on the inside surface of the cover.

9. The cosmetic container as claimed in claim 7, wherein the cover has a mirror mounted on the inside surface of the cover.

10. The cosmetic container as claimed in claim 8, wherein each bottle further has a press button mounted movably in the open top of the chamber and abutting the sprayer.

11. The cosmetic container as claimed in claim 9, wherein each bottle further has a press button mounted movably in the open top of the chamber and abutting the sprayer.

* * * * *